US006036333A

United States Patent [19]

Spiller

[11] Patent Number: 6,036,333

[45] Date of Patent: Mar. 14, 2000

[54] WATER FAUCET GENERATED EMERGENCY LIGHTING SYSTEM

[76] Inventor: Andrew Spiller, 6956 Tulip St., Philadelphia, Pa. 19135

[21] Appl. No.: 09/304,044

[22] Filed: May 4, 1999

[51] Int. Cl.[7] ..... F21V 31/00

[52] U.S. Cl. ..... 362/192; 362/96; 290/43; 73/861.87

[58] Field of Search ..... 362/192, 193, 362/96, 253; 290/54, 43, 35; 73/861.74, 861.75, 861.79, 861.87, 861.77

[56] References Cited

U.S. PATENT DOCUMENTS

| | | | |
|---|---|---|---|
| 3,845,291 | 10/1974 | Portyrata | 362/192 |
| 4,564,889 | 1/1986 | Bolson | 362/192 |
| 4,616,298 | 10/1986 | Bolson | 362/192 |
| 4,731,545 | 3/1988 | Lerner | 290/54 |
| 4,740,711 | 4/1988 | Sato et al. | 290/52 |
| 4,951,915 | 8/1990 | Piao | 74/89.17 |
| 4,963,780 | 10/1990 | Hochstrasser | 310/104 |
| 5,040,945 | 8/1991 | Levesque | 415/124.1 |
| 5,043,592 | 8/1991 | Hochstrasser | 290/52 |
| 5,349,985 | 9/1994 | Fischer | 137/607 |

*Primary Examiner*—Alan Cariaso
*Assistant Examiner*—Hargobind Sawhney
*Attorney, Agent, or Firm*—Henderson & Sturm LLP

[57] ABSTRACT

An emergency lighting system 10 for use on the outlet 101 of a conventional faucet 100 and including a generally T-shaped housing member 20 having a cross-arm portion 22 that is connected on one end 24 to the faucet outlet 101 and has an interior fluid flow deflector element 26 disposed above the intersection of the cross-arm portion 22 with the stem portion 21 of the housing member 20 which contains a power generating unit 12 and an illumination unit 13; wherein, the power generating unit 12 includes a turbine element 26 which is positioned beneath the fluid flow deflector element 26 for supplying electrical current to the illumination unit 13 when pressurized water flows over the fluid flow deflector element 26.

5 Claims, 1 Drawing Sheet

WATER FAUCET GENERATED EMERGENCY LIGHTING SYSTEM

BACKGROUND OF THE INVENTION

1. Field of the Invention

The present invention relates to the field of emergency illumination systems in general and, in particular, to an emergency lighting system that is powered by the flow of water through a common water faucet.

2. Description of Related Art

As can be seen by reference to the following U.S. Pat. Nos. 5,349,985; 5,043,592; 5,040,945; 4,963,780; and, 4,740,711, the prior art is replete with myriad and diverse water generated power systems that convert the velocity of running water into electrical power.

While all of the aforementioned prior art constructions are more than adequate for the basic purpose and function for which they have been specifically designed, they are uniformly deficient with respect to their failure to provide a simple, efficient, and practical emergency lighting system that can quickly and easily be attached to the outlet of a conventional water faucet to provide illumination during power blackouts or the like.

As most people are aware, when routine electrical service is interrupted, usually the only conventional utility that still functions in the normal fashion is the municipal water supply.

As a consequence of the foregoing situation, there has existed a longstanding need for a new and improved type of emergency lighting system that converts the output from a conventional water faucet into electrical energy that will power an emergency light source; and, the provision of such a system is the stated objective of the present invention.

BRIEF SUMMARY OF THE INVENTION

Briefly stated, the emergency lighting system that forms the basis of the present invention comprises, in general, a housing unit, a power generating unit, and an illumination unit wherein the power generating and illumination units are operatively associated with the housing unit which is adapted to be connected directly to the outlet of a conventional faucet.

As will be explained in greater detail further on in the specification, the housing unit includes a hollow T-shaped housing member wherein water from the household faucet flows directly through the cross arm element of the housing element and the power generating unit and the illumination unit are operatively associated with the shaft element of the housing element.

In addition, the interior of the cross-arm element is further provided with a fluid flow deflector element which is designed to increase the velocity of the water flowing past the flow deflector element and to direct the fluid flow over a portion of the impeller vanes that project radially outwardly from a turbine element connected to an axial input shaft connected to a generator member that supplies electrical power to the illumination unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
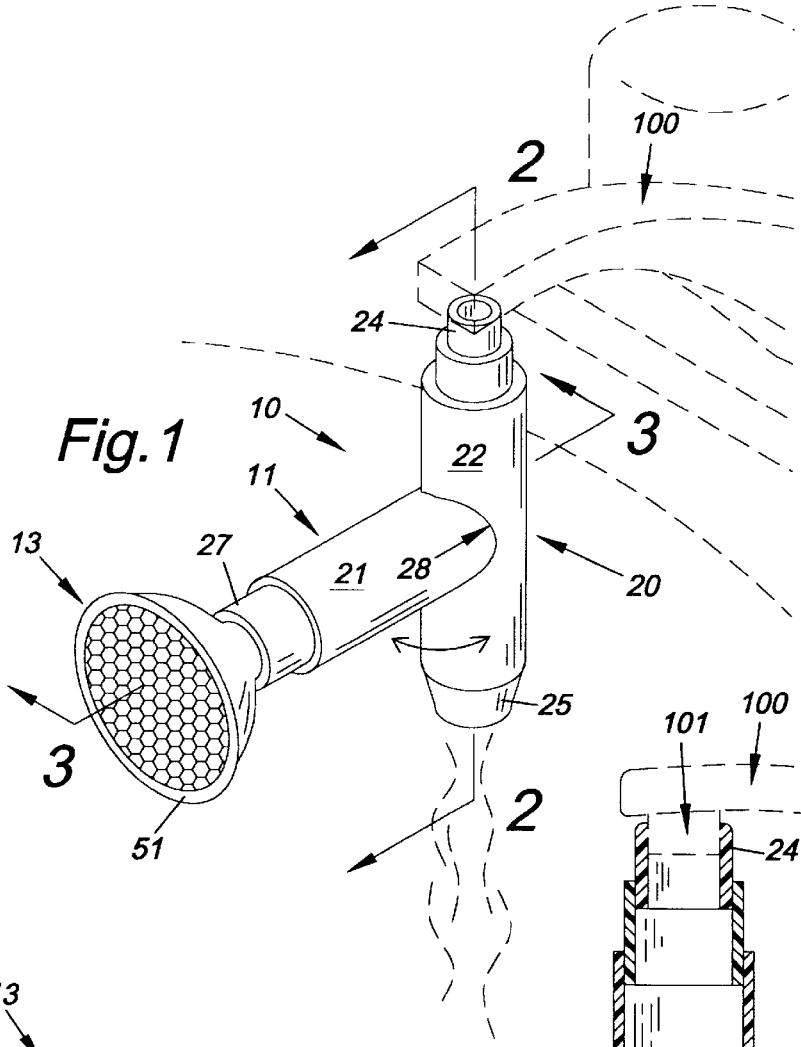
FIG. 1 is a perspective view of the emergency lighting system connected to a conventional water faucet.

As can be seen by reference to the drawings, and in particular to FIG. 1, the emergency lighting system that forms the basis of the present invention is designated generally by the reference number 10. The lighting system 10 comprises in general a housing unit 11, a power generating unit 12, and an illumination unit 13. These units will now be described in seriatim fashion.

Figure 2:
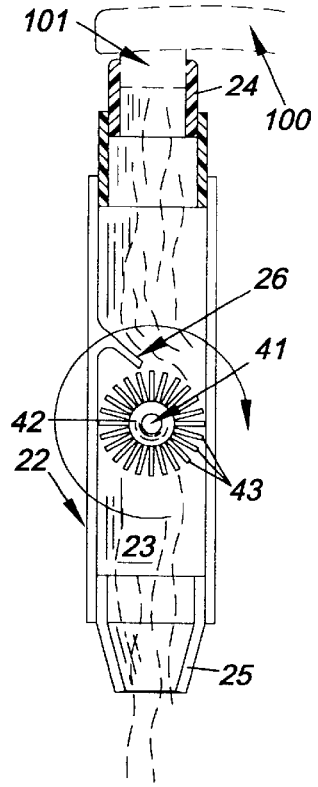
FIG. 2 is a front cross-sectional view taken through line 2—2 of FIG. 1.
Figure 3:
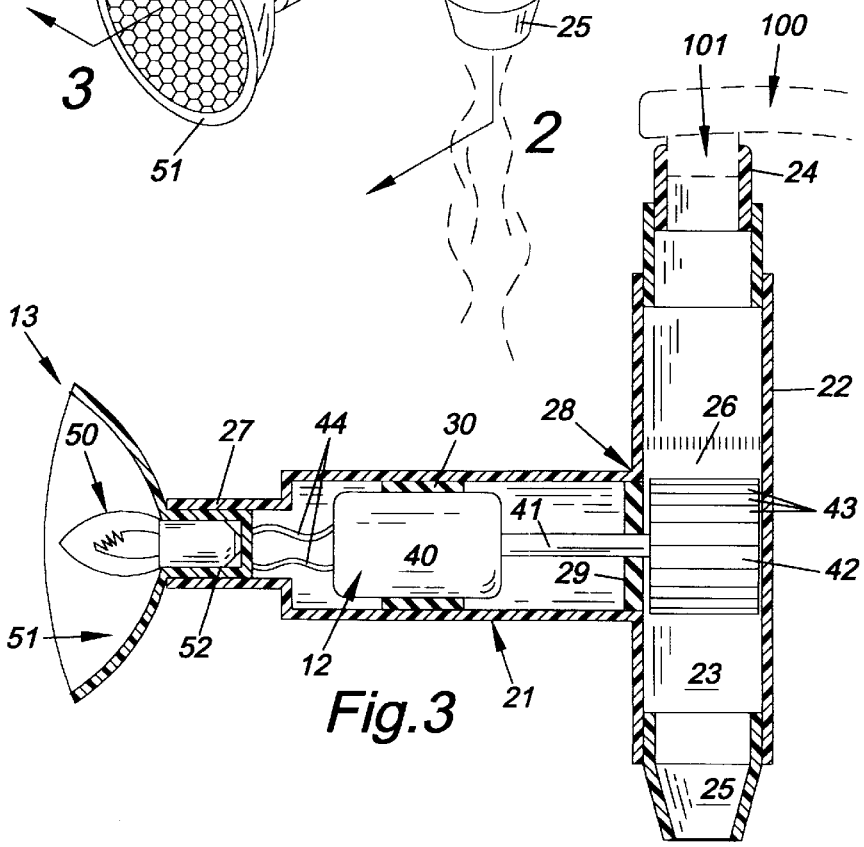
FIG. 3 is a side cross-sectional view taken through line 3—3 of FIG. 1.

As shown in FIGS. 1 through 3, the housing unit 11 comprises in general a hollow T-shaped housing member 20 having a shaft portion 21 and a cross-arm portion 22 which defines an internal fluid passageway 23 wherein the upper end of the cross-arm portion 22 is provided with a resilient fluid coupling element 24, the lower end of the cross-arm portion 22 is provided with a nozzle element 25 and the intermediate section of the cross arm portion 22 is provided with a stationery fluid flow deflector element 26 whose purpose and function will be described in greater detail further on in the specification.

In addition, as shown in FIG. 3, the hollow shaft portion 21 of the housing member 20 is provided with a reduced diameter outer end 27 which is dimensioned to receive a portion of the illumination unit 13 and the interior of the inner end 28 of the shaft portion 21 is provided with a sealing membrane 29 whose purpose and function will be described presently.

As can best be seen by reference to FIGS. 2 and 3, the power generating unit 12 comprises in general an electrical generator member 40 disposed within the intermediate portion of the hollow shaft portion 21 of the housing member 20 and having an axial input shaft 41 projecting rearwardly from the generator member 40 and projecting in a rotary water tight fashion through the sealing membrane 29 which separates the interior of the shaft portion 21 from the cross-arm portion 22 of the housing member 20 wherein the outboard end of the rotary input shaft is provided with a rotary turbine element 42 which is disposed in the intermediate section of the cross-arm portion 22 of the housing member 20 and further provided with a plurality of radially arranged impeller vanes 43 which are disposed below the stationary fluid flow deflector element 26 to impart clockwise rotary movement to the axial input shaft 41 to produce electrical current that will flow out of the electrical generator member 40 through electrical connectors 44 to the illumination unit 13.

In addition, as shown in FIG. 3, the shaft portion 21 of the housing member 20 is further provided with a resilient collar element 30 which forms a watertight seal around the generator member 40 to prevent any water than may leak past the membrane 29 from migrating past the resilient collar element 30 to short out the illumination unit 13.

As shown in FIGS. 1 and 3 the illumination unit 13 comprises a lamp member 50 sealingly engaged within a reflector housing element 51 having a reduced diameter inner end 52 that is dimensioned to be received in the reduced diameter outer end 27 of the shaft portion 21 of the housing member 20 wherein the lamp member 50 is electrically coupled to the electrical connectors 44 in a well-recognized fashion.

At this juncture, it should be noted that as shown in FIG. 2, the rotary turbine element 42 and the associated vanes are disposed in the cross-arm portion 22 of the body member 20 proximate the juncture of the cross-arm portion 22 relative to the shaft portion 21.

Furthermore, it can be seen that the fluid flow deflector element 26 is positioned above the rotary turbine element 42 to not only divert the fluid flow to ne side of the cross-arm portion 22 of the body member 20 thereby increasing the velocity of the fluid exiting from the outlet of the deflector element 26 and to direct the increased velocity fluid flow towards one side of the turbine element 42; wherein, the impact of the pressurized fluid on the impeller vanes 43 will impart rotary movement to the generator shaft 41 to produce electrical current that will flow to the light member 50 in a well recognized fashion.

In addition, as shown in FIG. 1, the lighting system 10 may be rotated relative to the outlet 101 of a conventional faucet 100 so that the illumination unit 13 can be directed in an arc of rotation relative to the axis of the outlet 101 of the faucet 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An emergency lighting system for use on the outlet of a conventional water faucet; wherein, the lighting system consists of:

a housing unit including a hollow T-shaped housing member having a cross-arm portion which is intersected by a stem portion; wherein, the cross-arm portion is provided with an upper end having a resilient fluid coupling element that is adapted to captively engage the outlet of the conventional water faucet, a lower end provided with a nozzle element, and a fluid flow deflector element extending outwardly from one side and disposed intermediate the upper and lower ends of the cross-arm portion of the body member at a location proximate the intersection of the stem portion with the cross arm portion of the body member;

a power generating unit substantially disposed within the stem portion of the body member and including a generator member sealingly engaged in the stem portion of the body member; wherein, the generator member is provided with an axial input shaft which extends at least partially into the cross-arm portion and in alignment with the longitudinal axis of the cross arm portion at a point below the fluid flow deflector element and wherein the axial input shaft is further provided with rotary turbine element for imparting rotary motion to the axial input shaft in response to pressurized fluid flowing over the fluid flow diverter element; and an illumination unit operatively associated with the shaft portion of the body member and electrically coupled to the generator member.

2. The lighting system as in claim 1; wherein, the stem portion of the housing member has an outer end which is operatively connected to the illumination unit.

3. The lighting system as in claim 2; wherein, the illumination unit includes a lamp member electrically coupled to the generator member and operatively surrounded by a reflector housing element which is disposed in the outer end of the stem portion of the housing member.

4. The lighting system as in claim 3; wherein, the stem portion of the body member has an inner end provided with a membrane element and the axial input shaft passes through the membrane element in a water tight fashion.

5. The lighting system as in claim 1; wherein, the rotary turbine element is provided with a plurality of radially aligned impeller vanes.

* * * * *